United States Patent [19]

Chaix et al.

[11] Patent Number: 4,625,789

[45] Date of Patent: Dec. 2, 1986

[54] DOUBLE BARRIER HEAT EXCHANGER

[75] Inventors: Jean E. Chaix, Manosque; Jean C. Chaix, Venelles; Jean L. Chaix, Pertuis, all of France

[73] Assignee: Commissariat a l'Energie Atomique, Paris, France

[21] Appl. No.: 403,415

[22] Filed: Jul. 30, 1982

[30] Foreign Application Priority Data

Aug. 10, 1981 [FR] France ..... 81 15451

[51] Int. Cl.[4] ..... F28D 7/02; G21C 17/00; G21C 19/28

[52] U.S. Cl. ..... 165/11.1; 165/70; 165/164; 165/169; 376/159; 376/250

[58] Field of Search ..... 165/70, 11 A, 11 R, 165/134 R, 164, 142, 162, 169; 376/250, 159

[56] References Cited

U.S. PATENT DOCUMENTS

| | | | |
|---|---|---|---|
| 3,509,759 | 5/1970 | Sinclair et al. | 376/250 |
| 3,969,077 | 7/1976 | Hill | 376/250 |
| 4,090,554 | 5/1978 | Dickinson | 165/11 R |
| 4,228,848 | 10/1980 | Wadkinson, Jr. | 165/11 R |

FOREIGN PATENT DOCUMENTS

| | | | |
|---|---|---|---|
| 0013796 | 8/1980 | European Pat. Off. . | |
| 0072736 | 2/1983 | European Pat. Off. | 165/11 R |
| 2105117 | 8/1972 | Fed. Rep. of Germany . | |
| 2738351 | 3/1978 | Fed. Rep. of Germany | 376/250 |
| 1507968 | 4/1978 | Fed. Rep. of Germany . | |
| 2810699 | 9/1979 | Fed. Rep. of Germany . | |
| 2943949 | 5/1981 | Fed. Rep. of Germany . | |
| 7106710 | 11/1972 | Netherlands | 376/159 |
| 1536291 | 12/1978 | United Kingdom . | |

OTHER PUBLICATIONS

Atom Energie, vol. 75, No. 9/10, Sep./Oct. 1966, pp. 357-366, Henzel et al., "Zor Lokalisterung von Brennelementhülenschäden in Kernreaktoren".

*Primary Examiner*—William R. Cline
*Assistant Examiner*—John K. Ford
*Attorney, Agent, or Firm*—James E. Nilles

[57] ABSTRACT

The present invention relates to a double barrier heat exchanger between a radioactive primary fluid and a secondary fluid making it possible to detect a possible primary fluid leak in the exchanger. The primary fluid circulates in a primary duct and the secondary fluid circulates in a secondary duct, a junction matrix being positioned between the primary and secondary ducts and in contact with the latter. The matrix is in the form of a compact metallic mass incorporating at least one element, e.g. silver, which can be made raidoactive when it diffuses into the primary fluid. Application is to sampling circuits in nuclear reactors.

11 Claims, 5 Drawing Figures

DOUBLE BARRIER HEAT EXCHANGER

BACKGROUND OF THE INVENTION

The present invention relates to a double barrier heat exchanger more particularly intended for the cooling of the radioactive primary water of a sampling circuit of a water reactor, which in particular makes it possible to detect a leak of the primary liquid in said exchanger.

A certain number of auxiliary circuits are connected to the primary circuit of a nuclear reactor and make it possible to check the satisfactory operation of the primary circuit and, if necessary, adjust the characteristics of the primary fluid. With regards to one of these circuits, called the sampling circuit used for sampling the primary liquid for analysis purposes, it is neccessary to cool the primary liquid from the core before carrying out the sampling operation. For this purpose, cooling takes place by means of a secondary cooling circuit. Most of the presently used exchangers do not completely protect the secondary circuit against risks of pollution by the primary fluid and generally do not make it possible to rapidly detect an accidental leak in the latter.

BRIEF SUMMARY OF THE INVENTION

The invention relates to a heat exchanger making it possible to not only protect the secondary circuit against the dangers resulting from a deterioration of the primary circuit, but also to make it possible to rapidly detect a primary liquid leak.

According to the main feature of the heat exchanger according to the invention with the radioactive primary fluid circulating in a primary duct and the secondary fluid circulating in a secondary duct, the exchanger comprises a junction matrix positioned between the two ducts and in contact therewith, said matrix being in the form of a compact metallic mass and comprising at least one element able to diffuse into the primary fluid when it is in contact with the latter and which is made radioactive under the action of an activation source. Thus, the fact that the junction matrix is metallic and is in compact form ensures a good thermal conductivity between the primary and secondary ducts and gives a good mechanical strength to the complete apparatus.

According to another feature of the invention, the element which can be made radioactive when entrained by the primary fluid is silver. Thus, such an exchanger comprises two "barriers", one between the primary duct and the matrix and the other between the matrix and the secondary duct. The apparatus according to the invention offers increased safety because it makes it possible to detect a defect in the first barrier (e.g. a primary fluid leak) well before the second barrier is subject to the action thereof.

Thus, if a leak occurs, e.g. as a result of the perforation of the primary duct, the primary liquid acts on the matrix and silver ions diffuse into the primary circuit of the reactor. During the passage into the core, they are activated into silver 110 under the action of the neutron flux. This anomaly can be detected in the form of an increase of the peak of said radioactivity in the radiation chemistry spectrum carried out periodically on primary samples. Thus, the first barrier of the exchanger can be very rapidly detected by the monitoring of this peak.

According to another feature of the invention, the secondary duct has a thermal expansion coefficient substantially equal to that of the junction matrix, which obviates the disadvantages due to thermal expansion phenomena.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
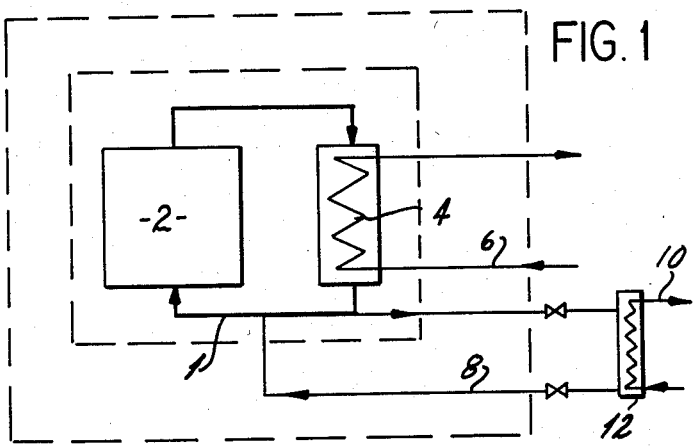
FIG. 1 a diagrammatic view of a heat exchanger according to the invention placed in a sampling circuit connected to the primary circuit of a reactor.

In the diagrammatic view of FIG. 1, it is possible to see the primary circuit 1 of a nuclear reactor permitting the primary fluid to pass from the core 2 where it is heated in contact with fuel cans to a heat exchanger 4, where it is cooled in contact with the fluid circulating in the secondary circuit 6 of the reactor before returning to the core. A sampling circuit 8 is connected to the primary circuit downstream of exchanger 4 and makes it possible to take samples of the primary fluid for analysis. However, even at the outlet of exchanger 4, the primary fluid is still too hot to be able to take the samples and it is necessary to cool it by a fluid circulating in a secondary cooling circuit 10, said cooling taking place in a heat exchanger, 12. Various embodiments of such an exchanger are possible, as a function of the geometry of the primary and secondary ducts.

Figure 2:
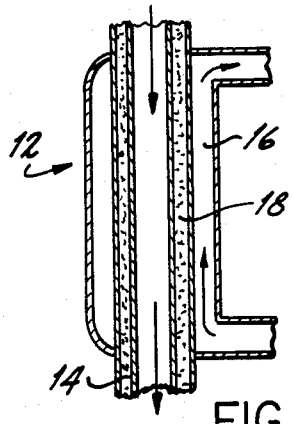
FIG. 2 a diagrammatic sectional view of an embodiment of an exchanger according to the invention in which the primary duct is in the form of a straight tube, whilst the secondary duct has an annular shape.

In the embodiment shown in FIG. 2, it can be seen that the primary duct is shaped like a straight tube 14 surrounded by an annular enclosure 16 in which circulates the secondary cooling liquid, the primary tube 14 and the annular enclosure 16 being separated by a space 18 filled by the junction matrix used within the scope of the present invention.

Figure 3:
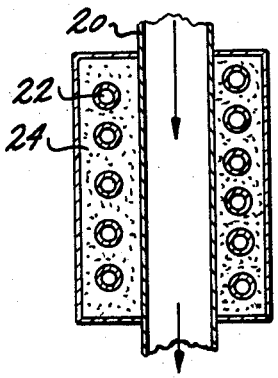
FIG. 3 a diagrammatic sectional view of another embodiment in which the primary duct is in the form of a straight tube and the secondary duct in the form of a coil or helix.

In the case of FIG. 3, the primary duct is shaped like a cylindrical tube 20, but the secondary duct 22 is shaped like a helix or coil surrounding the primary duct and is embedded within a matrix 24 placed around tube 20 and in contact with the latter.

Figure 4:
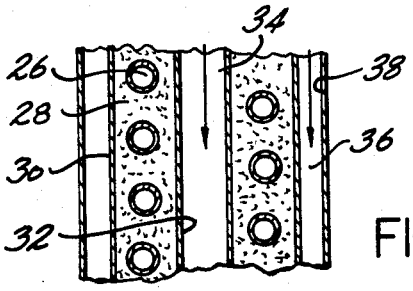
FIG. 4 a diagrammatic sectional view showing a third embodiment with the primary duct in the form of a coil or helix and the secondary duct having an annular shape.

In the embodiment of FIG. 4, the primary duct 26 is shaped like a helix embedded in a junction matrix 28, the latter being positioned beteen two outer and inner cylindrical walls 30, 32 respectively in the drawing. The secondary fluid circulates on the one hand in the tubular space 34 defined by inner wall 32 and on the other hand in an annular space 36 defined by outer wall 30 and an outer wall 38.

Figure 5:
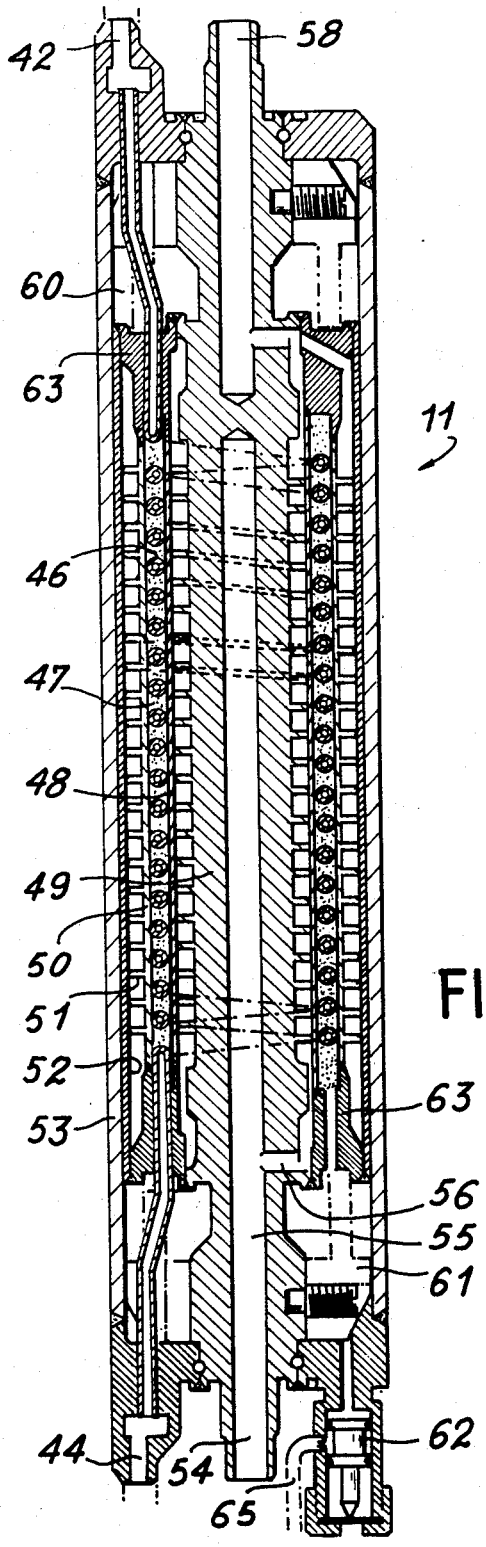
FIG. 5 a diagrammatical sectional view of a heat exchanger according to the invention in which the primary duct is in the form of a helix or coil separated by a matrix from a secondary duct defined by the threads of two square threaded screws.

FIG. 5 illustrates an embodiment of an exchanger according to the invention in which the primary duct is shaped like a helix, whilst the secondary fluid circulates in the spaces defined by the threads of two square threaded screws.

The primary liquid enters the cylindrical exchanger 11 by an inlet 42 located at one end and leaves it at the other end through an outlet 44 after circulating in a helix 46, whose axis substantially coincides with that of tube 11. This helix is embedded in a junction matrix 47 made from an alloy of silver and copper. Within the cylinder defined by helix 46 and in contact with matrix 47 is arranged a cylindrical wall 48 called the "inner cylindrical wall" throughout the remainder of the text and having the same axis as tube 11, whilst the externally threaded member 49 is placed within wall 48 in such a way that its thread is in contact with the inner face of the latter. The longitudinal section of the thread of member 49 is essentially shaped like a square and for this reason is called a "square threaded screw".

From the outside of the cylinder defined by helix 46, matrix 47 is in contact with a second cylindrical wall 50 called the "outer cylindrical wall" and which is merely the inner face of a second externally threaded square headed screw 51 and within which are disposed matrix 47, helix 46 and the first square headed screw 49. Finally, an outer wall 52 is in contact on the one hand with the thread of screw 51 and on the other with the outer envelope 53 of tube 11. The secondary fluid enters through an opening 54 located at the end of tube 11 by which the secondary liquid is discharged into a hole 55 within member 49 and substantially along the axis of the latter. An opening 56 links hole 55 with the spaces defined on the one hand by the threads of screws 49, 51 and on the other by walls 48, 52. Thus, the secondary fluid follows a double helical path around the primary helix 46 before being discharged at the other end of tube 10 by an outlet 58. This arrangement makes it possible to have a good thermal exchange coefficient and gives the apparatus a good rigidity, so that it is possible to reduce the thickness of the inner and outer cylindrical walls.

In the special case described here, matrix 47 is a binary alloy of copper and silver obtained by casting a ternary eutectic alloy of silver, copper and cadmium, the latter volatilizing at the time of casting. This operation is performed under a neutral atmosphere and at a temperature of approximately 930° C., so that the primary helix or coil is made from an alloy with a high nickel content (e.g. INCONEL 800 or INCOLOY) in order not to bring about any deterioration of the primary duct at the time of casting. The other members in the exchanger and in particular the square headed screws constituting the secondary ducts are made from stainless steel 316 L. The use of this steel type makes it possible to prevent thermal expansion problems, because the thermal expansion coefficient of stainless steel is $17\times10^{-6}$, whilst that of the silver—copper alloy used for forming the junction matrix is $16.5\times10^{-6}$. In addition, the matrix forms an excellent heat bridge between the primary and secondary ducts due to the good conductivity of the silver and copper. Finally, this alloy has a good mechanical strength, which makes it possible to reduce the thickness of the primary tube and the secondary duct, the thickness of said members being determined solely as a function of the corrosion problems.

Two cavities 60, 61 are provided at each end of tube 11 in order to recover the primary or secondary liquid which may escape in the case of a leak.

The outer envelope 53 of tube 11 is protected against overpressures as a result of a leak by a safety valve 62. The detection of leaks with such an apparatus takes place as follows. If primary tube 46 is perforated, the primary fluid comes into contact with the alloy forming the junction matrix and silver ions diffuse into the primary circuit and are activated in silver 110 after passing into the reactor core. Thus, the primary duct leak is detected by absorbing the peak of the silver on the radiochemistry spectrum which is periodically carried out.

Moreover, the primary liquid escaping from helix 46 can open up a path along the latter and reach the end members 63 and from there enter cavities 60 or 61. The liquid circulating in the primary helix 46 is under high pressure, so that there is an increase in the pressure in the cavity 61 and consequently a displacement of valve 62, which frees the discharge opening 65. It is consequently possible to detect the operating anomaly, e.g. by an alarm which is given when the liquid passes out of opening 65. The primary liquid can also act on the junction matrix and thus reach the wall defining the secondary duct. At this moment and under the action of pressure, there can be a separation of the matrix or an advance of the liquid along the interface and the primary fluid flows along said interface up to end parts 63 and again issues into cavity 61. The leak can then be detected as a result of safety valve 62. However, it should be noted that in all cases the junction matrix action or attack phenomenon is sufficiently slow to permit the detection of the anomaly by observing the peak of silver 110, generally well before the fluid enters cavities 60 or 61. It is therefore possible to rapidly intervene and replace the defective device before it is completely destroyed.

Thus, the apparatus according to the invention has particularly interesting advantages, because it permits a good heat exchange between the primary liquid and the secondary liquid, a good mechanical behaviour of the assembly even when the latter has thin walls and also makes it possible to rapidly detect a leak in the primary duct because in the case of perforation of the latter, one of the elements constituting the junction matrix diffuses into the primary liquid and can easily be detected by a spectrographic control.

The invention is obviously not limited to the embodiments described hereinbefore and can cover numerous variants without passing beyond the scope of the invention. Thus, as appropriate, an expert in the art can choose the most appropriate shapes for the primary and secondary ducts, as well as the materials forming these ducts and the junction matrix.

What is claimed is:

1. A double barrier heat exchanger comprising a primary duct allowing passage of a radioactive primary fluid and a secondary duct allowing passage of a secondary fluid, a space being provided between said primary duct and said secondary duct, said heat exchanger further comprising a junction matrix positioned within said space and in contact both with the primary duct and the secondary duct, said matrix being in the form of a solid compact metallic mass and incorporating at least one element able to diffuse into the primary fluid when it is in contact with said primary fluid and able to become radioactive when it is submitted to the action of an activation source.

2. A heat exchanger according to claim 1, wherein the thermal expansion coefficient of the secondary duct is substantially the same as that of the junction matrix.

3. A heat exchanger according to claim 1, wherein the element of the matrix which can be made radioactive is silver.

4. A heat exchanger according to claim 3, wherein the matrix is formed by a binary alloy of silver and copper.

5. A heat exchanger according to claim 1, wherein said junction matrix is made from a ternary eutectic alloy of silver, copper and cadmium.

6. A heat exchanger according to claim 1, wherein the primary duct is formed from an alloy with a high nickel 7. A heat exchanger according to claim 1, wherein the secondary duct is made from stainless steel.

8. A heat exchanger according to claim 1 wherein said primary duct is in the form of a straight tube surrounded by said junction matrix, said junction matrix being surrounded annularly by said secondary duct.

9. A heat exchanger according to claim 1, wherein the primary duct is shaped like a straight tube surrounded by a matrix within which is arranged the secondary duct in the form of a helix.

10. A heat exchanger according to claim 1, wherein said primary duct is shaped like a helix embedded in said junction matrix, said junction matrix being annularly surrounded by said secondary duct.

11. A heat exchanger according to claim 1, wherein said primary duct is shaped like a helix embedded in said junction matrix, said junction matrix being in contact with an inner cylindrical wall having an inner face and an outer face and an outer cylindrical wall having an inner face and an outer face, said heat exchanger further comprising an externally threaded cylindrical member disposed inside said inner wall and whose thread is in contact with the inner face of said inner wall, and wherein said outer wall has a thread on its outer face which is in contact with a surrounding outer wall, said secondary duct being constituted by the spaces defined on the one hand by the thread of the threaded cylindrical member and the inner wall and, on the other hand, by the thread of the outer cylindrical wall and the surrounding outer wall.

* * * * *